United States Patent [19]

Schilling

[11] 4,226,581

[45] Oct. 7, 1980

[54] SAFE START CHECK CIRCUIT

[75] Inventor: Roger A. Schilling, West St. Paul, Minn.

[73] Assignee: Honeywell Inc., Minneapolis, Minn.

[21] Appl. No.: 972,533

[22] Filed: Dec. 22, 1978

[51] Int. Cl.[3] ..... F23Q 23/00

[52] U.S. Cl. ..... 431/26; 431/24; 431/73; 431/74

[58] Field of Search ..... 431/21, 24, 26, 73, 431/74, 79, 80

[56] References Cited

U.S. PATENT DOCUMENTS

| | | | |
|---|---|---|---|
| 3,277,946 | 10/1966 | Forbes . | |
| 3,306,339 | 2/1967 | Barton et al. | 431/26 |
| 3,376,099 | 4/1968 | Giuffrida et al. | 431/26 |
| 3,395,968 | 8/1968 | Mobarry et al. | 431/45 |
| 3,449,055 | 6/1969 | Blackett | 431/26 |
| 3,504,993 | 4/1970 | Cade | 431/26 |
| 3,574,495 | 4/1971 | Landis | 431/26 |
| 3,644,074 | 2/1972 | Cade | 431/26 |
| 3,830,619 | 8/1974 | Cade | 431/26 |
| 4,077,762 | 3/1978 | Matthews | 431/45 |
| 4,111,639 | 9/1978 | Matthews | 431/26 |

OTHER PUBLICATIONS

Catalog Sheet 60-2034-2, revised 9-75, Honeywell RA890F Flame Safeguard Primary Control.

*Primary Examiner*—Joseph Man-Fu Moy
*Attorney, Agent, or Firm*—Alfred N. Feldman

[57] ABSTRACT

A safe start check circuit for a fuel burner is disclosed. Two relays are arranged to insure proper start and to protect against component failure. Delays in operating the relays, and a normally closed control relay contact serve to both prevent relay races and provide protection against a solid state switch means failure.

10 Claims, 1 Drawing Figure

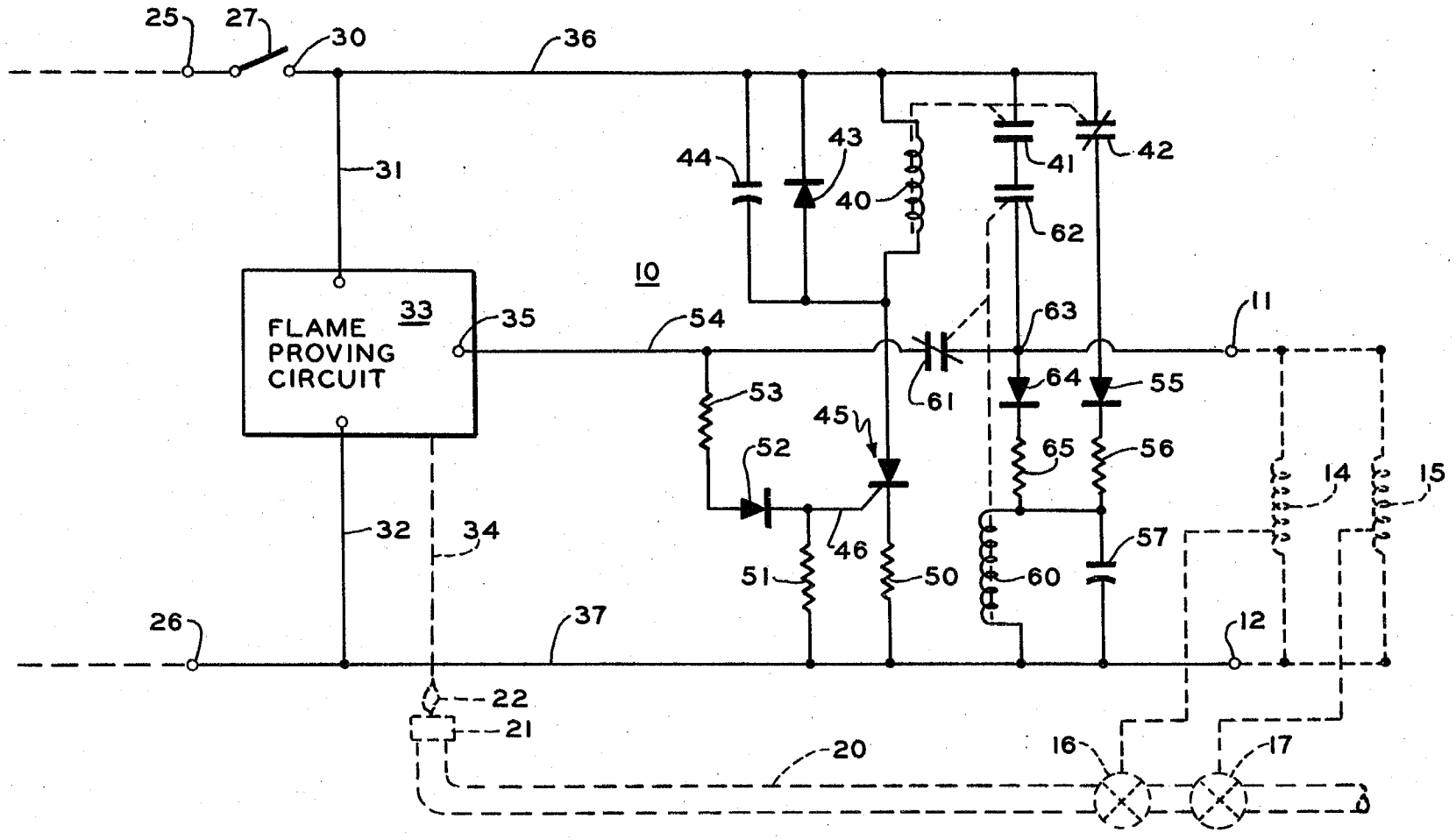
FLAME PROVING CIRCUIT
33
10
11
12
14
15
16
17
20
21
22
25
26
27
30
31
32
34
35
36
37
40
41
42
43
44
45
46
50
51
52
53
54
55
56
57
60
61
62
63
64
65

SAFE START CHECK CIRCUIT

BACKGROUND OF THE INVENTION

Since the advent of the sharp rise in fuel prices and the possibility of fuel shortages, a number of conservation measures have been undertaken. Certain of the conservation ideas for gaseous fuels have been mandated by state legislatures. It has been common practice for many years to use a very simple, inexpensive and reliable pilot arrangement for gas fired equipment. In the past it has been common to use a standing pilot, that is one that continuously burns and is monitored by a flame sensing device, such as a thermocouple. This type of a system has proved to be very inexpensive, and reliable. Many state legislatures have now mandated that the standing pilot is not in the country's best interest in fuel conservation, and the standing pilot must be replaced with some other type of fuel ignition arrangement.

One type of fuel ignition arrangement that is coming into prominence is a system normally referred to as a direct spark ignition system. In this type of system an electric spark is generated across a gap to ignite a gaseous fuel as it emanates from a gas burner. This type of arrangement, while it appears to be simple and straight forward, creates some very serious safety problems. Firstly, there is a problem of properly igniting a fuel; secondly, there is a problem of a gas valve failure which would allow for the continuous flow of raw fuel into a burner when none was required. This can be not only wasteful, but very hazardous. In order to alleviate the hazard in a direct spark ignition type of system, it has become common, and even required, that two gas valves be placed in series so that the failure of one valve will not preclude the closing of the fuel flow channel by the second valve. This type of arrangement is generally referred to as the redundant valve arrangement.

Where the valves are controlled electronically, an additional problem is created in that electronic components may failure in modes which may cause an unsafe condition in a direct spark ignition system. Also, there is a problem of possible welding of relay contacts which may be used to control the electric current to the fuel valve. Any direct spark ignition system for control of fuel flow valves must also take into consideration the failure modes of the electronic components and, therefore must be designed so that any component failure causes a shut down of the fuel flow. This is considered to be a safe mode of failure.

SUMMARY OF THE INVENTION

The present invention is a simplified combination of an electronic control system and a dual relay circuit for the control of fuel to a fuel burner. The simple relay configuration insures the proper response to a flame proving circuit, and also helps insure against component failure of the electronic components.

In the present invention, a pair of relays are used which each have slight time delay functions so that the proper relay operation can be obtained without a "relay race". In many systems that utilize relays, a "relay race" occurs when one relay pulls in slightly ahead of another relay in an undesirable fashion. In the present invention slight time delays insure that a control relay pulls in before a flame sensitive relay. With this operation a silicon controlled rectifier that operates the flame responsive relay can be kept disabled to detect failures of certain components. The relay contact configuration is also selected so that a single contact always operates to open and close all of the current flowing to the valve means of the fuel burner. In this way, a single pair of contacts always handles both the opening and closing of the load circuit and the contacts can be sized to avoid problems with contact welding. The other contact in the load circuit is a "dry" contact. "Dry" contacts are contacts which open and close but do not make or break the circuit. The system further has a safety function in that one of the elements in the flame relay circuit is a current responsive or fusible type of element, in the form of an ordinary resistor, which opens circuits in the event of a failure of the silicon controlled rectifier in one of its more common failure modes. If the silicon controlled rectifier fails in a diode mode, this will also be detected and the system will not start up.

With the novel arrangement provided, failure of any of the components tends to provide a shutdown of the valve means immediately or will cause the system to refuse to start or open the valves unless normal operation is possible.

BRIEF DESCRIPTION OF THE DRAWING

The single FIGURE is a schematic diagram of a control system for redundant fuel flow valves.

DESCRIPTION OF THE PREFERRED EMBODIMENT

A safe start check circuit for redundant fuel flow valves is generally disclosed at 10. In the present discussion the system will be described as a redundant gas flow system for conventional gas that is supplied to a furnace or similar fuel burning appliance. The control system 10 is adapted to be connected by terminals 11 and 12 to the solenoid coils 14 and 15 of two gas valves generally closed at 16 and 17. The two gas valves 16 and 17 are connected in a gas flow pipe or channel 20 which in turn terminates in a burner 21. A gas flame is disclosed at 22. The equipment described to this point is conventional and is not directly part of the present invention. The invention uses the control circuit 10 for operating the two gas valves 16 and 17 in a safe start check mode.

The control system 10 is energized at a pair of terminals 25 and 26 from a conventional alternating current source. The terminal 25 is connected through a switch 27 which may be a manual switch or in a more conventional type of system would be a thermostat. The type of switch 27 is not material. The closing of switch 27 applies an alternating current potential to an input terminal 30 for the system 10. A pair of conductors 31 and 32 supply power to a flame proving circuit or condition responsive means 33. The condition responsive means 33 is specifically disclosed as a flame responsive or flame proving means 33. The condition responsive means 33 has any convenient means 34 for monitoring the flame 22 at the burner 21. This could be a simple flame rod, flame rectification system, photocell or ultraviolent arrangement. The only requirement is that the condition responsive means 33 can be capable of monitoring the flame or condition 22 and provide a control output on a terminal 35. The condition responsive or flame responsive means 33 also has a rather unusual function in that an output appears at the terminal 35 for a short period each time power is applied on the conductors 31 and 32. A similar type of condition responsive or flame detection system can be found in the U.S. Pat. No. 3,619,097 to Homer B. Clay which was issued on Nov. 9, 1971 to the assignee of the present invention. The Clay patent contains a capacitor voltage divider network which briefly energizes the device so that a flame can be established at an associated burner. If a flame is established, the voltage divider network is kept continuously recharged. If no flame is present, the voltage divider bleeds off and the system locks itself out. A similar arrangement could be provided in the present flame proving means 33 to provide a momentary or brief output on conductor 35. The means 33 then must respond to a flame at the sensor 34 within a set period of time. This function is necessary for the proper operation of the inventive system, and it will be described in more detail in connection with the operation of the system.

Terminal 30 provides electrical energy on conductor 36 while terminal 26 provides a ground or common connection on conductor 37. Conductor 37 is also directly connected to terminal 12 which ultimately acts as the common or ground side for the solenoids 14 and 15. Conductor 36 is connected to a number of further circuits. The first circuit includes a flame relay 40 which operates a normally open contact 41 and a normally closed 42. The relay coil 40 is paralleled by a free wheeling diode 43 and a capacitor 44 which can act to provide a time delay, if necessary.

The relay 40 is connected to a series with a silicon controlled rectifier generally disclosed at 45 and which has a gate 46. The silicon controlled rectifier 45 can be any type of solid state switch means that is gated and is further connected through what has been shown as resistor 50. The resistor 50, in fact, is a current responsive safety element and in its simplest form would be a carbon resistor which could open circuit on carrying an excessive amount of current. The current responsive safety means 50 can also be any other type of fusible element such as a conventional fuse. The gate 46 has a further resistor 51 in the normal connection between the gate and the common conductor 37, and is connected by a diode 52 and a resistor 53 to a conductor 54 which connects to terminal 35 of the flame proving circuit means 33. A gating signal is normally supplied on conductor 54 to the gate 46 of the silicon controlled rectifier 45 when it is desired to energize the flame relay 40. This function is overridden by elements that will be described below, and which are used for the safe start check in the system.

The conductor 36 is connected through the normally closed contact 42 to a diode 55, a resistor 56 and a capacitor 57 that is in turn connected to a conductor 37. This is the first control circuit for the device and the capacitor 57 provides a time delay function for energizing a relay 60 which is connected across the capacitor 57. The relay 60 has a normally closed contact 61 and normally open contact 62. The normally open contact 62 is connected in series with the normally open contact 41 and is connected at junction 63 to the conductor 54. Connected from the junction 63 to the relay 60 is a further diode 64 and a resistor 65.

To this point all of the components of the safe start check circuit have been recited but one further circuit parameter should be noted. The terminals 11 and 12 provide a connection means for a pair of solenoids 14 and 15 for the valve 16 and 17. The impedance or resistance between the terminals 11 and 12, made up of the resistances of the coils 14 and 15 is of a relatively low magnitude to a direct current and are connected to conductor 54 through the normally closed relay contact 61 and the gate 45 of the silicon controlled rectifier 45. It can thus be seen that as long as the normally closed contact 61 is in the closed condition, that effectively a short exists between the conductor 54 and the conductor 37 thereby shorting out the gate of the silicon controlled rectifier 45 and keeping it from becoming conductive. This is an important part of the present invention.

OPERATION

To initiate the operation of the system, the switch or thermostat 27 closes. This supplied power to the flame proving circuit means 33 and to the balance of the safe start check circuit 10. A voltage immediately is available at terminal 35 that is supplied to the conductor 54. Since the normally closed contact 61 is closed, this voltage is effectively shorted out by the impedance between the terminals 11 and 12.

At this same time, voltage is supplied on conductor 36 through the normally closed contact 42 and through the diode 55, and resistor 56 to the capacitor 57. After a very brief time delay, the relay 60 is energized thereby closing the contact 62 and opening the shorting contact 61. If a flame signal is still provided on conductor 54, the silicon controlled rectifier 45 immediately begins to conduct. The conduction of the silicon controlled rectifier 45 pulls in the relay 40 which closes the contact 41 and opens contact 42. The opening of contact 42 removes the voltage from the first control circuit which includes the time relay capacitor 57 but completes a circuit from the conductor 36 via the junction 63 to the terminal 11 to supply power to the solenoids 14 and 15. The solenoids 14 and 15 then open the valves 16 and 17 to admit gas to the burner 21. As is common in this type of system, the closing of switch 27 and the operation of flame proving circuit means 33 also energizes a source of ignition potential for the gas emanating from the burner 21. This is normally provided by a direct spark type of ignition system.

In view of the presence of an ignition source, the opening of valve 16 and 17 provides fuel or gas to the burner 21 where it is ignited and a flame 22 appears. This is sensed via 34 to the flame proving circuit 33 and the voltage is retained on terminal 35 to keep the silicon controlled rectifier 45 in conduction. It will be noted that in this normal start-up or operating sequence that the contact 41 handled all of the power to the solenoids 14 and 15 as the contact 62 was closed before 41 opened.

Upon the opening of the switch 27, power is removed from the solenoids 14 and 15 and due to the time delay characteristics of the two relays 40 and 60, the contact 41 opens after the contact 62. As such, the opening and closing power is supplied to the solenoids 14 and 15 solely through the contact 41. This allows for the selection of the contact material of the relay contact 41 such as to provide good life without welded relay contacts.

In the event of certain types of components failures the present system will fail in a safe mode. One of the most common failures is in a solid state switch means, such as the silicon controlled rectifier 45, becoming either a diode or short circuit. In either case, the system operates in a safe manner. If the silicon controlled rectifier 45 becomes a short circuit, the current responsive safety means 50 or resistor is selected so that it opens circuits in a relatively short period of time, thereby de-energizing the circuit for the flame relay 40. This prevents the valves 16 and 17 from being energized. In the event that the silicon controlled rectifier 45 acts as a diode, the conduction of the silicon controlled rectifier 45 upon application of power by the closing of switch 27 causes the relay 40 to be energized closing contact 41 and opening the contact 42. Opening contact 42 prevents the control relay 60 from ever being energized and thereby keeps the contact 62 continuously open. This prevents the solenoids 14 and 15 from ever being energized.

The above noted types of failures are the most common failures protected against, and since the time delay functions of the two relays 60 and 40 can be selected, no relay race is possible between these elements. The fact that the normally closed contact 61 keeps the silicon controlled rectifier 45 out of conduction until the control relay 60 has been energized provides a complete safe start check circuit for a fuel burner.

The above circuitry is shown in a highly simplified manner with only the essential elements provided. The concept of the use of slight time delays in the relays and a normally closed contact to short out the gate of a gated solid state switch means could be applied in a number of circuit configurations and therefore, the applicant wishes to be limited in the scope of his inventions solely by the scope of the appended claims.

The embodiments of the invention in which an exclusive property or right is claimed are defined as follows:

1. A safe start check circuit for a fuel burner, including: flame response means adapted to sense a flame at a fuel burner and to provide an output signal upon the presence of a flame; gated solid state switch means responsive to said output signal; said solid state switch means connected in a series circuit with flame relay means to a source of electric potential with said relay means having a normally open contact and a normally closed contact; a first control circuit including said normally closed relay contact in series with a diode, and a capacitor which are connected across said source to provide a time delay; control relay means responsive to a charge stored in said capacitor and including a normally open contact and a normally closed contact; a control relay holding circuit comprising said normally open relay contacts, a second diode, and said control relay connected across the said source; terminal means connected to said second diode and said control relay with said terminal means adapted to connect said source to valve means for said fuel burner through both said normally open relay contacts; and said normally closed contact of said control relay means including connection means to effectively short circuit said gated solid state switch means through said valve means until said control relay means is energized to thereby assure that a safe condition exists before said flame relay means normally open contact can close to energize said valve means.

2. A safe start check circuit as described in claim 1 wherein current responsive safety means is connected in series circuit with said flame relay means and said solid switch means.

3. A safe start check circuit as described in claim 1 wherein said first control circuit includes a resistor in series with said time delay capacitor and wherein said series combination controls the length of said time delay.

4. A safe start check circuit as described in claim 1 wherein said flame relay means includes a capacitor in parallel with a relay coil to create a time delay in operation of said flame relay means.

5. A safe start check circuit as described in claim 1 wherein said valve means includes a pair of valve coils in parallel circuit with the resistance of said parallel combination being low enough to short circuit said solid state means gate through said normally closed relay contact of said control relay means thereby preventing said solid state switch means from conducting until said control relay means operates.

6. A safe start check circuit as described in claim 5 wherein said flame relay means includes a capacitor in parallel with a relay coil to create a time delay in operation of said flame relay means.

7. A safe start check circuit as described in claim 6 wherein said first control circuit includes a resistor in series with said time delay capacitor wherein said series combination controls the length of said time delay.

8. A safe start check circuit as described in claim 7 wherein current responsive safety means is connected in series circuit with said flame relay means and said solid state switch.

9. A safe start check circuit as described in claim 8 wherein said solid state switch means in a silicon controlled rectifier.

10. A safe start check circuit as described in claim 9 wherein said current responsive safety means is a fusible element.

* * * * *